United States Patent [19]

Arnaud

[11] Patent Number: 4,882,661

[45] Date of Patent: Nov. 21, 1989

[54] PROCESS FOR THE ENHANCEMENT OF LIGHT STRUCTURES AND LIGHT INSTRUMENT

[76] Inventor: Annick Arnaud, 23, rue de Pontoise, F-95160 Montmorency, France

[21] Appl. No.: 194,987

[22] PCT Filed: Sep. 3, 1987

[86] PCT No.: PCT/FR87/00343

§ 371 Date: May 2, 1988

§ 102(e) Date: May 2, 1988

[87] PCT Pub. No.: WO88/01709

PCT Pub. Date: Mar. 10, 1988

[30] Foreign Application Priority Data

Sep. 4, 1986 [FR] France ..... 86 12442

[51] Int. Cl.[4] ..... F21V 13/00

[52] U.S. Cl. ..... 362/242; 362/231; 362/806; 362/811

[58] Field of Search ..... 362/227, 231, 242, 367, 362/806, 811

[56] References Cited

U.S. PATENT DOCUMENTS

| | | | |
|---|---|---|---|
| 3,564,332 | 2/1971 | Blakeslee | 315/154 |
| 3,694,645 | 9/1972 | Brantz | 362/811 X |
| 3,790,772 | 2/1974 | Newman et al. | 362/811 X |
| 3,805,049 | 4/1974 | Frank et al. | 362/811 X |
| 4,386,916 | 6/1983 | Beal | 362/811 X |

FOREIGN PATENT DOCUMENTS

| | | |
|---|---|---|
| 1500122 | 9/1967 | France . |
| 2136917 | 12/1972 | France . |
| 2529065 | 12/1983 | France . |
| 849680 | 9/1960 | United Kingdom . |

*Primary Examiner*—Stephen F. Husar

*Attorney, Agent, or Firm*—Larson & Taylor

[57] ABSTRACT

Animation of lighting structures. Method and instrument implementing a plurality of extensive sources of lights having intensities which vary independently in the course of time and optionally a colored spectrum which also varies. The variations of the different sources which are either localized or global are controlled in real time by an operator or may be programmed. The controlled parameters are preferably the direction and the speed of the intensity variation. Application to the making of instruments for the creation and interpretation of light scores.

8 Claims, 1 Drawing Sheet

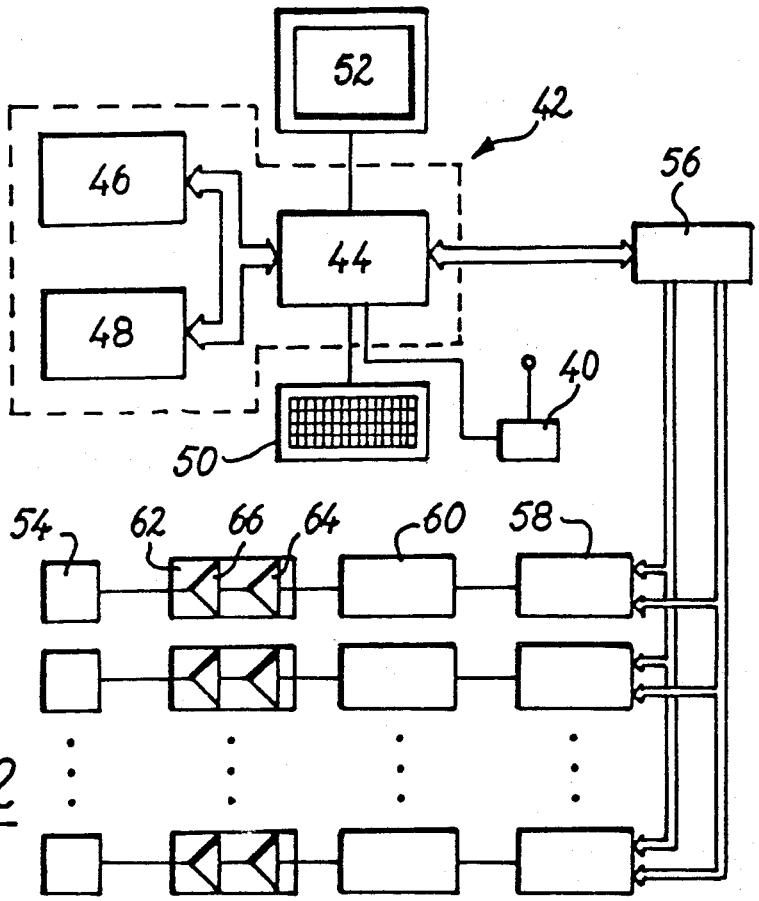
Fig 2
Fig 1
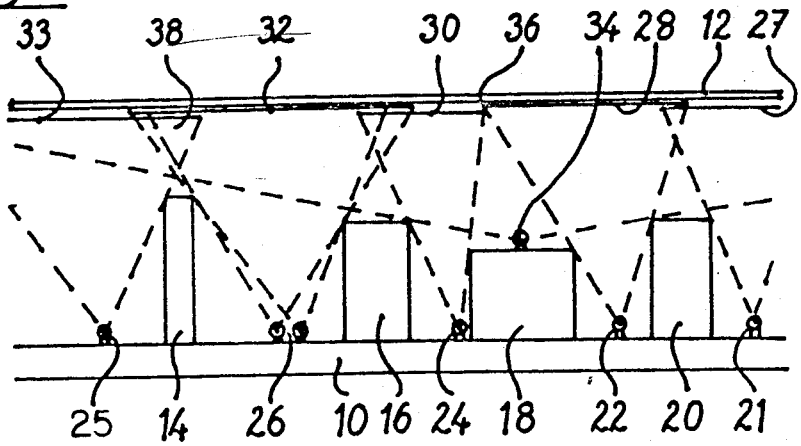

PROCESS FOR THE ENHANCEMENT OF LIGHT STRUCTURES AND LIGHT INSTRUMENT

TECHNICAL FIELD OF THE INVENTION

The present invention concerns an illuminating instrument, in other words an instrument which is intended to be controlled by an operator and to produce lights which vary or fluctuate. Such an instrument allows the composition of light divisions which can then be played repeatedly by interpreters or expositors, in the same manner as a pianist executes a musical piece which has been composed beforehand. The instrument can also be played automatically, by programmed control, in the same manner as a mechanical piano or a street organ.

To comprehend the invention, it is useful to consider a parallel between the domain of music and that of light and color.

In the musical domain, obviously after the basic components of rhythm or dynamics and the association of sounds, there exist only two fundamental parameters, the frequency and the intensity of any one sound. These parameters and components together define a "plan" in which a sound may be defined by one point. However, it is difficult to obtain pure sounds and, in practice, instruments have been developed which each give associations of sounds characteristic of very individualized musical concordances. One single piece of music gives very different effects on different instruments.

In the domain of lights, the fundamental parameters which are at the disposal of the user are more numerous since they are three in number: they define a "space" in which a "light" is defined by a point (this space is known as the "Munsell color system"). Of course, secondary parameters analogous to those of the musical domain are also present in the domain of lights: association of lights (spectrum), dynamic characteristics (growth and decline).

This analogy between music and "lights" however is not so simple as has been indicated and it is intended solely for understanding of the diversity of the possible commands in a light instrument, a diversity which is a great deal more extensive than in the musical domain.

Just the same as an apparatus capable only of emitting sounds is not a musical instrument (it is the respect for certain conditions which gives its musical character to a sequence of sounds), an apparatus capable of emitting lights is not necessarily a light instrument. In fact, it is the condition of the selection of the lights and their variations which make that instrument a light instrument and a genuine instrument allowing artistic expression.

It is possible to consider that a television monitor is a light instrument of the bidimensional type, to the extent that the images formed satisfy the conditions of selection. When a television monitor reproduces an image filmed directly with the aid of a camera, it does not constitute a true light instrument since it is occupied solely with restitution of a scene of which the camera avails itself in its totality. On the other hand, when the camera is used to display a synthesized image, the assembly comprising the monitor and the means which have been used to create this synthesized image constitute a light instrument.

It is known that the synthesis of television images is a considerable practice requiring considerable technical skill, given the very large number of points to be defined in one single image. This work becomes inordinate when a truly animated or enhanced program must be realized because it requires several tens of images per second. It is therefore obvious that the operator of such a system cannot "play" the instrument in real time since months of work are required for creation of a short sequence of a few seconds. The route of television synthesis of images then does not permit the realization of a light instrument which can be played in real time.

The known instruments to give a play of light often call attention less to the artistic domain than to that of advertising.

PRIOR TECHNOLOGY

Apparatuses are already known which comprise light source which are not very extended, are in pinpoints or are linear. The most current are those constituted by gas discharge signs. These signs sometimes coprise several complicated motifs, sometimes placed before a color background which may be uniform or may not. These devices do not constitute true light instruments because they are fixed: the various linear elements function in an all or nothing manner, and the only parameters at the disposal of an operator are the time periods for illumination and extinction of each element. This restriction of the parameters over which an operator has disposal gives this type of apparatus its mechanical and repetitive character which rapidly bores and turns away the observers. It is only when an assembly is formed of numerous separate independent signs that one can generally recognize a certain artistic flavor (as the view of a downtown area at night, from aboard an aircraft at low altitude).

Apparatuses having extended light sources are also known, comprising for instance a focusing screen with a large surface behind which is placed a source which is of large dimensions (constituted for instance of series of rectilinear discharge tubes placed side by side). A colored composition is displayed on this focusing screen. The entirety constitutes a work in light, but this is not a light instrument, because the sole possibility of control by the operator, aside from an optional overall regulation of the intensity, is a change of the composition, as though one is changing a slide transparency or a negative.

Great Britain Pat. No. 849 680 describes an apparatus intended to give polychromatic effects and having a wrinkled or crimped reflecting surface and sources placed in front of this surface. It does not concern transparent or translucent composition, in other words it does not concern working by transmission, nor does it concern sources placed behind the composition.

French patent application No. 2 529 065 concerns a decorative assembly in which an opaque picture element is illuminated from a source in front of it.

French patent application No. 2 136 917 concerns a process of enhancement or animation according to which the light is projected on a surface from the front. This surface is neither translucent nor transparent.

DESCRIPTION OF THE INVENTION

The invention is based upon the determination of conditions which allow the realization of a true light instrument which can be controlled by an operator, a composer, or interpreter or expositor. It also concerns a process for the creation of light scores by enhancement of a light structure, and an instrument allowing the composition and interpretation of such scores.

The principal conditions which must be satisfied in a light instrument are the following.

First of all, the instrument must form a bidimensional or tridimensional light structure which is static. This structure must include at least two extended sources having different effective zones. (The bidimensional or tridimensional region wherein the illumination varies when the light intensity and/or the light spectrum of the extended source varies is called "effective zone".) Preferably, the structure also includes at least one overall extended source, in other words an extended source of which the effective zone covers over a large part of or the entire structure. According to the invention, the extended sources which are used present progressive variations, independent and controlled relative to their light intensity and/or their light spectrum.

The apparatus is of great interest when as many as four sources are being used, and the number of sources being used is preferably equal to eight.

The sources are preferably of at least two different colors. It is also particularly advantageous that the order of at least one extended source be able to vary or fluctuate, in other words that the light source have a light spectrum which varies or fluctuates in the course of time, independently from its fluctuation or variation in intensity or in conjunction with its intensity variation or fluctuation.

Preferably, the sum of the effective zones of the sources covers the entire or almost the entire visible support structure. It is advantageous that an extended source have at least one effective zone which covers the greatest portion of the visible support structure. This source or these sources are called "background" sources hereinafter in the present specification, as opposed to the "partial" sources which each have a relatively reduced effective zone, for example less than one fourth of the visible structure.

The effective zones of the extended source are preferably overlapping. Thus, it is advantageous that the effective zones of the partial sources cover over those of the background sources. However it is also advantageous that the effective zones of certain partial sources which are adjacent to each other be overlapping. This characteristic is important because it allows one single element of the instrument to present different colors according to the ratios or relations of intensities or the spectra of the different light sources.

The extended light sources must present variations of intensity in a wide range, which preferably may extend as far as the complete extinction of the source, and also, the sources preferably present variations of light spectra. These variations of intensity and/or of spectrum of the extended light sources advantageously have time constants on the order of one second to several tens of seconds. Of course, this condition is included in general and overall terms, but does not exclude either local or temporal different conditions, such as a constant maintenance or a very rapid variation of light source. If the intensity of a source is held at a constant level, then a part of the structure becomes fixed, and this must be avoided unless this fixed aspect is actually the intended objective which is sought. A rapid variation or fluctuation constitutes an assault when it is repeated too often. On the other hand, a rapid variation or fluctuation of one single source or of a small number of sources, in an occasional manner, accentuates the composition and gives an interesting effect.

The process satisfying the aforementioned conditions allows the composition and interpretation of true scores of light, in which the operator at any moment controls the variations of intensity and optionally of color of the various light sources. It is preferable that this control be assured by control of the type of variation and the velocity of variation of the intensity of each source or of each group of sources, when the number of sources is sufficiently large.

Since the controls of variation or fluctuation of intensity and color of the light sources can be assured by purely static means, for instance electronic circuits, the instrument can itself be entirely static, without any movable part other than those parts controlled by the operator in order to introduce the commands.

More precisely, the invention concerns a process for the enhancement of a light structure comprising a composition having extended surfaces and several light sources, comprising the realization of a composition in transparent or translucent form, the arrangement of the light sources on the side of the composition opposite that of the observer, the light sources being made up of extended sources, each having an effective zone within the composition, or groups of such extended sources, and the progressive variation, independent and controlled, of the intensity of each of the extended sources and each group of extended sources.

The process advantageously comprises the use of light sources on the one hand in the form of partial sources or groups of partial sources, each having an effective zone which covers only a small part of the composition, and on the other hand in the form of at least one background source having an effective zone, the sum of the effective zones of the background sources of one single color being equal to the entirety or almost the entirety of the composition. The background light sources are to be of different colors.

The invention also concerns a light instrument of the type which forms a light structure which comprises a composition having extended surfaces and a plurality of light sources, the composition being transparent or translucent, the light sources being placed on the side of the composition which is opposite and facing that of the observer, wherein the light sources are extended sources, each having an effective zone, the instrument besides that including devices which are intended to cause variation of fluctuation of the light intensity of certain light sources or certain groups of sources at least. It is advantageous that the instrument comprise at least one extended background light source having one effective zone, the sum of the effective zones of the background sources covering over practically the entirety or almost the entire light structure.

It is advantageous that the instrument comprise at least one device which is intended to cause variation of the color of the light from at least one extended light source. The extended source having a color which varies can be made up of at least two elementary sources having different light spectra, and the device which is intended to cause the variation or fluctuation of the color is made up of a device intended to cause the variation or fluctuation of the relations of the light intensities of the elementary sources.

An extended background light source is preferably formed of a plurality of partial sources of which the variations of intensity are controlled simultaneously by one single control device.

It is advantageous that the devices intended to cause the variation of fluctuation of the light intensity of each source or of each group of sources comprise a computer and a data entry device. In one embodiment, the data entry device is a data acquisition device having a plurality of command channels for direction and variation of speed. In another embodiment, the data entry device is a data display reader device to read data which has been progammed in the memory beforehand.

In one embodiment, the light structure of the instrument is bidimensional, and the instrument comprises a support frame, a diffusion plate placed before the frame and together constituting a composition, a plurality of elementary light sources supported by the frame, color filters placed between at least some of the sources and the diffusion plate, and a command device to control the variation or fluctuation of the light intensity of each elementary source.

In another embodiment, the light structure of the instrument is tridimensional, and the instrument includes a support frame, a plurality of extended sources each comprising at least one elementary source and an extended source which is illuminated at least in part by at least one elementary source, with the extended sources being mounted in several different planes, and a command device to control the variation or fluctuation of intensity of each source.

In this last embodiment, the extended illuminated surfaces which are illuminated by the elementary light sources and which can have any shape or form, such as flat, cylindrical, conical, hemispherical or corrugated, can be sources operating by transmission or by reflection.

BRIEF DESCRIPTION OF THE DRAWING

Other characteristics and advantages of the invention will be understood more clearly from the following description, in reference to the attached drawing, wherein:

FIG. 1 shows a transverse cross section of a part of a bidimensional light structure according to one embodiment of the invention; and FIG. 2 is a diagram of the command or control apparatus of the light sources of the structure of FIG. 1.

DETAILED DESCRIPTION OF THE EMBODIMENTS

The apparatus shown partially in FIG. 1 forms the light structure of a light instrument according to the invention. This apparatus comprises a rear plate 10 intended to constitute a frame or support for the other elements of the structure. This plate can be of any sufficiently rigid material and it is preferably opaque. A diffusion plate 12 is mounted at some distance from plate 10, in front of it, by devices which are not shown but are of any suitable type.

A plurality of extended light sources are formed by the apparatus. Each extended light source comprises one or more light elementary sources, a surface limiting and defining the effective zone of the source, and optionally a deflector limiting the field of the light source or its effective zone.

More precisely, FIG. 1 shows five partial extended light sources and one background extended source. These sources are formed by elementary light sources 21, 22, 24, 26 and 25, by deflectors 14, 16, 18 and 20 and by extended surfaces which in this case are constituted of colored filters applied against the diffusion plate and carrying references 27, 28, 30, 32 and 33. For an observer placed at some distance on the other side of the diffusion plate, the spots of color corresponding to the filters appear to be juxtaposed and are sometimes partially overlapping.

Deflector 18 carries an elementary light source formed by a light 34 which is nearer the diffusion plate than the other sources and which has an effective zone which is much more extended since it in fact covers over all of the effective zones of the other extended sources. This is a "background extended light source" or a background source, contrary to the other extended sources which are called "partial" sources because they have only limited effective zones.

One embodiment is to be considered. Filter 30 may be a yellow filter and light source 24 a blue light: the effective zone of light 30 will appear to an observer to be yellow or green, according to its intensity. On the other hand, however, if light 34 illuminates this same filter 30 with a red light, this effective zone will then appear to be orange or red, according to the intensity of the light. Therefore it is possible to obtain different colors by means of one single placement of the elements of the light structure, by application of different and separate commands to the various elementary sources.

The partial extended source comprising filter 32, deflectors 14 and 16 and elementary source 26 comprises two different lights placed behind one single filter. The two lights can be controlled in such a manner that the relation of their intensities varies. If the two lights emit light beams of different colors, the visible color of the effective zone of this light will vary for the observer.

Although it has been indicated that the effective zones of the extended sources were defined by the filters, said filters are not indispensable. In fact, if the elementary light sources are themselves colored, the effective zones will be colored. The colors of the different zones can be clearly separated, as shown by reference 36, in other words they can be without any overlap. However they can also be overlapped, as shown by reference 38, where the colors of the two zones appear to the observer to be merged together.

The most significant possibility allowed by the invention is the variation or fluctuation of the light intensity of each source, preferably relatively slow, with time constants on the order of a few seconds to some tens of seconds. Therefore it is necessary according to the invention that this intensity be able to be controlled according to the invention. This characteristic is obtained with an apparatus as shown in FIG. 2.

The apparatus shown in FIG. 2 provides for regulation of the intensities of several elementary light sources, independently from each other, by use of data indicating on the one hand the type of variation of intensity and on the other hand the speed of said variation. In practice, the data introduced for each elementary light source are on the one hand the change or lack of change of the direction of variation and on the other hand an elementary pitch of elementary variation of the intensity in a very short period, preferably shorter than the twenty-fifth of a second. A constant intensity is obtained by constant change of the direction of variation, or by use of anullment of the pitch.

FIG. 2 shows two devices for data entry, on the one hand a joy stick 40 for data entry and on the other hand a computer 42. The joystick determines the proper elementary light source by its azimuth, the amplitude of the pitch by the amplitude of its displacement in relation to the central position, and the direction by the depression or lack of depression of the joystick in its support. Of course, the joystick at any certain moment gives only the data concerning one simple elementary light source. It is therefore necessary that suitable devices retain the value of the pitch of each source until the subsequent command or until a threshold value is reached. Of course, these data can be furnished by a computer 42 which in the traditional manner comprises a central processor 44, a main or RAM memory 46 and passive or ROM memory 48, a keyboard 50 and a screen 52.

The signals from the joystick or the computer cannot be used directly by the lights, and they in fact constitute command signals only. Each light source 54 is therefore associated with a transmission channel comprising, starting from an input-output circuit 56 having data lines and address lines, a register 58 (which may be of the 74LS273 type), a digital-analog converter 60 (for instance of the DAC0800 type), and an amplification stage 62 comprising an operational amplifier 64 (which may be of the LM741 type) and a power transistor 66 (for instance of the TIP120 type) suitably connected to an input furnishing the energy required for the light sources 54.

Before being able to compose a light score, the user must realize the light structure, in other word first execute an operation of plastic art: positioning of the lights and the deflectors which define the effective zones, selection and arrangements of the filters which in and of themselves already form a colored composition but which have the drawback of being static. The invention then allows the enhancement of this composition, by action taken on the intensities and their contrasts, and by accentuation or reduction of the color contrasts.

Although an embodiment of the bidimensional type has been described, the invention also concerns tridimensional structures. In this case, a plurality of extended light sources are placed in close proximity with each other. These sources can give or not give variations of color but will always allow variations of fluctuations of intensities. The extended light sources can be of any form. Interesting results have been obtained with elementary light sources placed in colored translucent wrappers, with hollow open cylinders at one end and having an elementary light source which is not directly visible, and with rippled forms giving effects of cast shadows.

In the case of a tridimensional structure, the composition is advantageously one single uncolored diffusion plate which allows the differences of depth of the various sources to be distinguished from each other.

One advantage of the invention is that the light instrument can be purely static and have no movable part, except for the data entry device. However, some particular effects can be obtained by coupling the instrument with dynamic elements, for instance a motor which moves a movable member. Thus, a motor can be used for control of an obturator or a revolving polarizer intended to cause the variation or fluctuation of the intensity of a light source of which the intensity cannot be directly modulated (for instance a gas discharge tube). However, these are only optional elements, as are also any plurality of pinpoints or linear light sources, in other words non-extended light sources, added to the instrument.

POSSIBILITIES OF INDUSTRIAL EXPLOITATION

The instruments according to the invention are suitable either in the form of instruments allowing for artistic expression, or as decorative elements controlled by computer and participating in the enhancement or animation of public places.

What is claimed is:

1. A process for forming a changing light display to be viewed by an observer comprising the steps of:

providing a static composition having an extended surface and which is transparent or translucent;

projecting light onto respective effective zones of the extended surface from a plurality of extended light means, the light means all being mounted immovably relative to the static composition and on a side of the extended surface opposite to the observer, said projecting step including projecting light onto a plurality of respective partial effective zones which are only respective small parts of the extended surface from respective partial light sources of the light means, and projecting light onto a background effective zone which is substantially all of the extended surface from a background light source of a single color of the light means, and varying, progressively and independently, an intensity of each of the light means.

2. A process for forming a changing light display as claimed in claim 1 and further including the step of varying a color spectrum of the light from at least one of the light means.

3. A process for forming a changing light display as claimed in claim 1 wherein said projecting light onto respective partial effective zones step includes projecting light onto partial effective zones which overlap.

4. A process for forming a changing light display as claimed in claim 1 wherein said projecting light onto a background effective zone step includes projecting light from background light sources of at least two different color spectra of the light means.

5. A light instrument for forming a changing light display to be viewed by an observer comprising:

a static composition having an extended surface and which is transparent or translucent;

a plurality of extended light means for projecting light onto respective effective zones of said extended surface, said light means all being mounted immovably relative to said static composition and on a side of said extended surface opposite to that of the observer, said plurality of extended light means including at least two partial light sources, the light from each said partial light source being projected onto a respective partial effective zone which is only a small part of said extended surface, and at least one background light source of a single color, the light from said background light source being projected onto a background effective zone which is substantially all of said extended surface, and a varying means for varying the intensities of the light projected by said extended light means.

6. A light instrument according to claim 5 wherein said varying means also varies a color spectrum of the light from at least one of said light sources.

7. A light instrument according to claim 6 wherein said at least one of said light sources includes at least two light emitters having different color spectra, and wherein said varying means varies a ratio of the light intensities of said at least two light emitters.

8. A light instrument according to claim 5 wherein said at least one background light source includes a plurality of light emitters, and wherein said varying means varies the intensities of each said light emitter identically.

* * * * *